US005204219A

United States Patent [19]

Van Ooij et al.

[11] Patent Number: 5,204,219

[45] Date of Patent: Apr. 20, 1993

[54] PHOTOGRAPHIC ELEMENT WITH NOVEL SUBBING LAYER

[75] Inventors: Wim J. Van Ooij, Golden, Colo.; David R. Boston; Edward J. Woo, both of Woodbury, Minn.

[73] Assignee: Minnesota Mining and Manufacturing Company, St. Paul, Minn.

[21] Appl. No.: 824,903

[22] Filed: Jan. 21, 1992

Related U.S. Application Data

[63] Continuation of Ser. No. 693,780, Apr. 26, 1991, abandoned, which is a continuation of Ser. No. 79,687, Jul. 30, 1987, abandoned.

[51] Int. Cl.[5] ..... G03C 1/492

[52] U.S. Cl. ..... 430/272; 428/447; 430/523; 430/531; 430/533

[58] Field of Search ..... 430/272, 523, 950, 961, 430/531, 533; 428/447

[56] References Cited

U.S. PATENT DOCUMENTS

| | | | |
|---|---|---|---|
| 3,808,027 | 4/1974 | Anderson et al. | 117/47 A |
| 3,864,132 | 2/1975 | Rasch et al. | 96/85 |
| 4,069,368 | 1/1978 | Deyak et al. | 428/447 |
| 4,101,513 | 7/1978 | Fox et al. | 526/193 |
| 4,167,617 | 9/1979 | Siefken | 528/23 |
| 4,177,315 | 12/1979 | Ubersax | 428/447 |
| 4,188,451 | 2/1980 | Humphrey | 428/447 |
| 4,264,707 | 4/1981 | Uozumi et al. | 430/275 |
| 4,275,118 | 6/1981 | Baney et al. | 428/447 |
| 4,293,606 | 10/1981 | Zollinger et al. | 428/203 |
| 4,311,763 | 1/1982 | Conroy | 428/447 |
| 4,336,310 | 6/1982 | Okuyama et al. | 428/447 |
| 4,348,431 | 9/1982 | O'Malley | 428/447 |
| 4,388,437 | 6/1983 | Ona | 428/447 |
| 4,394,441 | 7/1983 | Kawaguchi et al. | 430/524 |
| 4,416,963 | 11/1983 | Takimoto et al. | 430/69 |
| 4,422,891 | 12/1983 | Gonser | 430/447 |
| 4,434,210 | 2/1984 | Nakajima et al. | 428/447 |
| 4,435,219 | 3/1984 | Greigger | 428/447 |
| 4,442,168 | 9/1984 | White et al. | 428/447 |
| 4,454,288 | 6/1984 | Lee et al. | 430/447 |
| 4,478,709 | 10/1984 | Taniguchi et al. | 428/447 |
| 4,482,656 | 11/1984 | Nguyen et al. | 428/447 |
| 4,507,383 | 3/1985 | Tsuruta et al. | 430/275 |
| 4,643,946 | 2/1987 | Brauer et al. | 428/447 |
| 4,680,232 | 7/1987 | Factor et al. | 428/447 |
| 4,816,333 | 3/1989 | Lange et al. | 428/331 |
| 4,879,175 | 11/1989 | Ugro, Jr. | 428/321.5 |

OTHER PUBLICATIONS

Kirk-Othmer *Encyclopedia of Chemical Technology*, 3rd Edition, vol. 20, "Silicon Compounds", pp. 855, 896, 914, 928, 929 and 968.

*The Encyclopedia of Polymer Science and Engineering*, vol. 15, "Silicones", pp. 219, 220, 232 and 233.

*Primary Examiner*—Jack P. Brammer

*Attorney, Agent, or Firm*—Gary L. Griswold; Walter N. Kirn; Mark A. Litman

[57] ABSTRACT

The use of a gelled network of inorganic oxide particles on the polymeric surface of a substrate provides a subbing layer having the potential for antistatic properties, antihalation properties, and good coatability.

15 Claims, No Drawings

PHOTOGRAPHIC ELEMENT WITH NOVEL SUBBING LAYER

This is a continuation of application Ser. No. 07/693,780 filed Apr. 26, 1991, which is a continuation of application Ser. No. 07/079,687 filed Jul. 30, 1987, now both abandoned.

BACKGROUND OF THE INVENTION

1. Field of the Invention

The present invention relates to photographic emulsions on substrates having a subbing or priming layer thereon.

2. Background of the Art

The construction of silver halide photographic elements has become an art that is an amalgum of many different sciences and technologies. Such varied disciplines as polymer chemistry, crystallography, physics, electrostatics, dye chemistry, coating technologies, and the like have to come into focus to produce what is to the consumer a simple snapshot.

Two complex problems that have traditionally been of concern to the photographic industry are adherence of the photographic emulsions to the substrates of choice (i.e., polymeric substrates such as polyester, polyolefin, or cellulosic ester bases and polymer coated paper bases such as white pigment filled polyolefin or polyvinylidene chloride coated paper). Another problem, particularly in high image content film which is processed mechanically is the development of static or triboelectric charges in the film which create spurious images.

Many different compositions, combinations of layers, and treatment of substrates have been proposed to effect better adhesion between emulsion layers and substrates as is evidenced by the number of patents in this technical area. A sampling of these patents include U.S. Pat. Nos. 3,271,345, 2,943,937, 4,424,273, 3,791,831 and the like. A great amount of work has also been directed in the photographic sciences to the elimination of electrostatic charges on photographic film. Examples of the diverse work done in this area includes U.S. Pat. Nos. 4,582,782, 3,884,699, 3,573,049 and the like.

Assorted handling problems (e.g., adhering of layers) are often addressed by the use of particulate matting agents in backside coatings or surface layers of photographic elements. Also sensitometric effects (e.g., light-scattering) are achieved by the use of particle-containing layers in photographic elements. These uses of particulate containing layers shown in U.S. Pat. Nos. 4,343,873, 4,144,064, 3,507,678, 4,022,622 and the like.

Typical photographic supports comprise a base material (e.g., polyester, cellulose triacetate, or paper) with a subbing layer on at least one surface to assist in the adherence of the gelatin layers, including the emulsion layers, to the base. Conventional subbing layers are described in U.S. Pat. Nos. 3,343,840, 3,495,984, 3,495,985 and 3,788,856.

SUMMARY OF THE INVENTION

The present invention relates to photographic elements having at least one silver halide emulsion layer over a substrate, where the substrate has at least one polymeric surface to which is adhered a layer comprising a gelled or hydrolyzed network of inorganic particles, preferably inorganic oxide particles, containing an ambifunctional silane.

DETAILED DESCRIPTION OF THE INVENTION

The present invention relates to photographic elements. These elements comprise a substrate having at least one silver halide emulsion layer on a surface thereof. A surface with an emulsion thereon is hereinafter referred to as a major surface of the substrate. The silver halide emulsion generally comprises silver halide grains (also referred to as crystals or particles) carried in a waterpenetrable binder medium of a hydrophilic colloid. It has been recently found that the use of a gelled or hydrolyzed network of inorganic particles, preferably oxides, as a layer on a polymeric surface provides an excellent subbed (or primed) substrate for photographic emulsions (U.S. patent application Ser. No. 40930, filed Apr. 21, 1987). It was found that this gelled particulate layer is capable of providing one or more excellent properties to the photographic element including, but not limited to antistatic properties, ease of coatability of the particulate layer, photoinertness (harmless to the photographic emulsion and its properties), adhesion (both wet and dry, to both the substrate and the emulsion layers), and reduction in specular reflectance (i.e., antihalation properties). However, it has been determined that wet adhesion can be weak during development processing. It has been hypothesized that the bond between the gelled network and the gelatin is an acid/-base bond. During the elevated pH conditions of development, this bond is sufficiently weakened so that other materials in the emulsion will compete with the gelatin for reaction with sites on the sol-gel coating. This can weaken the bond between the gelatin layer and gelled network layer. Lifting or separation of the layers can result.

It has been found according to the practice of the present invention that the addition of an ambifunctional silane into or onto the gelled network will produce a strong chemical bond between the inorganic particles and the gelatin.

The term ambifunctional silane means that the compound has reactive silanes on one end of the molecule and a different reactive species capable of reacting with a photographic hardener for gelatin or directly with gelatin. This second functionality enables the compound to react with the inorganic particle (through the silane group) and also react with the gelatin (reacting with the gelatin hardener which also reacts with the gelatin). Amongst the preferred second functional groups on the compound are amino groups and epoxy (e.g., glycidyl) groups. The second functionality may be present as a single functional moiety or may be present as a multiple number of such groups.

A formula that may be used to represent many of the ambifunctional silanes of the present invention is $$(Q)_n—R—Si(OR^1)_3$$

wherein $R^1$ is alkyl or aryl,

R is an organic group with (n+1) external bonds or valences, n is 0, 1 or 2, and Q is a moiety reactive with photographic hardeners or directly with gelatin (e.g., alpha-amino acids).

Preferably $R^1$ is alkyl of 1 to 10 carbon atoms and most preferably 1 to 4 carbon atoms. R is preferably an aliphatic or aromatic bridging group such as alkylene, arylene, alkarylene, or aralkylene which may be interrupted with ether linkages (oxygen or thioethers), nitrogen inkages, or other relatively inert moieties. More preferably R is alkylene of 1 to 12 carbon atoms, preferably 2 to 8 carbon atoms, with n equal to 1. Q is preferably epoxy, or amino, primary or secondary, more preferably primary amino.

Where previously indicated that the second functional group may be present as a multiple number of such groups it is meant that the moiety $(Q)_n$—R— may include moieties such as $NH_2—(CH_2)_2—NH—(CH_2)_2—NH—(CH_2)_3—$ $NH_2—(CH_2)—_3$ $(NH_2)_2—CH—CH_2—$

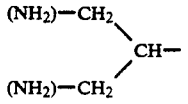

and the like.

The substrates of the invention may comprise any material having at least one polymeric surface which is to be used as the major surface of the substrate.

The silver halide photographic emulsions which are used in the present invention, as protective colloids, in addition to gelatin, include acylated gelatins such as phthalated gelatin and malonated gelatin, and may also contain cellulose compounds such as hydroxyethyl cellulose and carboxymethyl cellulose, soluble starch such as dextrin, hydrophilic polymers such as polyvinyl alcohol, polyvinyl pyrrolidone, and polyacrylamide, plasticizers for dimensional stabilization, latex polymers, and matting agents can be added. The finished emulsion is coated on a suitable support.

Supports which can be used include films of synthetic polymers such a polyalkyl acrylate or methacrylate, polystyrene, polyvinyl chloride, partial formalation polyvinyl alcohol, polycarbonate, polyesters such as polyethylene terephthalate, and polyamides, films of cellulose derivatives such as cellulose nitrate, cellulose acetate, cellulose triacetate, and cellulose acetate butyrate, paper covered with α-olefin polymers or gelatin (a natural polymer), for example, and synthetic papers made of polystyrene; that is, any of transparent or opaque support commonly used in photographic elements can be used. Primed polymeric substrates are also useful, including, but not limited to, gelatin-primed polymers (e.g., gelatin on poly(ethylene terephthalate)), and poly(vinylidene chloride) copolymers on polyester. Other primers such as aziridines, acrylates, and melamine-formaldehyde are also known. This includes polymeric materials loaded with pigments and particulates such as titania to improve the white background of the image and to provide antihalation or other sensitometric effects.

The substrates of the invention may be used with any type of photographic silver halides including, but not limited to silver chloride, silver bromide, silver chlorobromide, silver iodochlorobromide, silver bromoiodide and silver chloroiodide grains, which may be in any of the many available crystal forms or habits including, but not limited to cubic, tetrahedral, lamellar, tabular, orthorhombic grains, etc.

Soluble silver salts and soluble halides can be reacted by methods such as a single jet process, a double jet process, and a combination thereof. In addition, a procedure can be employed in which silver halide grains are formed under the presence of an excess of silver ions (a so-called reverse mixing process). A so-called controlled double jet process can also be employed in which the pAg of the liquid phase wherein the silver halide is formed is kept constant. Two or more silver halide emulsions which have been prepared independently may be used in combination with each other.

Soluble salts are usually removed from the silver halide emulsion after the precipitate formation or physical ripening of the silver halide emulsion. For this purpose, a noodle water-washing method can be employed in which the soluble salts are removed by gelling the emulsions. A flocculation method utilizing inorganic salts containing polyvalent anions, anionic surface active agents, anionic polymers or gelatin derivatives can also be used.

Although so-called primitive emulsions which are not chemically sensitized can be used as the silver halide emulsions, the silver halide emulsions are usually chemically sensitized. This chemical sensitization can be carried out, for example, by the methods as described in H. Frieser ed., *Die Grundlagen der Photographischen Prozesse mit Silverhalogeniden,* Akademische Verlagsgesellschaft, pp. 675–734 (1968).

That is, a sulfur sensitization method using sulfur-containing compounds capable of reacting with active gelatins and silver (e.g., thiosulfates, thioureas, mercapto compounds, and rhodanines), a reduction sensitization method using reducing substances (e.g., stannous salts, amines, hydrazine derivatives, formamidinesulfinic acid, and silane compounds), a noble metal sensitization method using noble metal compounds (e.g., gold complex salts, and metal complex salts of Group VIII metals, such as platinum, rhodium, iridium, and palladium, of the Periodic Table), and so forth can be used singly or in combination with each other.

The sulfur sensitization method is described in detail, for example, in U.S. Pat. Nos. 1,574,944, 2,410,689, 2,278,947, 2,728,668 and 3,656,955; the reduction sensitization method, in U.S. Pat. Nos. 2,983,609, 2,419,974 and 4,054,458; and the noble metal sensitization method, in U.S. Pat. Nos. 2,399,083, 2,448,060 and British Patent No. 618,061.

In photographic emulsions which are used in the present invention may be incorporated various compounds for the purpose of, e.g., preventing the formation of fog during the production, storage or photographic processing of the light-sensitive material, or stabilizing photographic performance. That is, many compounds known as antifoggants or stabilizers, such as azoles (E.G., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles, (particularly 1-phenyl-5-mercaptotetrazole), mercaptopyrimidines, mercaptotriazines, thioketo compounds (e.g., oxazolinethione), azaindenes (e.g., triazaindenes, tetraazaindenes (particularly 4-hydroxysubstituted-(1,3,3a,7)tetraazaindenes), and pentaazaindenes), benzenethiosulfonic acid, benzenesulfinic acid, and benzenesulfonic acid amide can be added.

Typical examples of such compounds and a method of using them are described, for example, in U.S. Pat.

Nos. 3,954,474, 3,982,947 and Japanese Patent Publication No. 28660/77.

The photographic emulsion layers of the light-sensitive material of the present invention may contain polyalkylene oxide or its derivatives (e.g., ethers, esters and amines), thioether compounds, thiomorpholines, quaternary ammonium salt compounds, urethane derivatives, urea derivatives, imidazole derivatives, 3-pyrazolidones, hydroquinone or its derivatives, and the like for the purpose of increasing sensitivity or contrast, or accelerating development. For example, compounds as described in U.S. Pat. Nos. 2,400,532, 2,423,549, 2,716,062, 3,617,280, 3,722,021, 3,808,003 and British Patent No. 1,488,991 can be used.

As binders or protective colloids to be used in the emulsion layers and intermediate layer of the light-sensitive material of the present invention, it is advantageous to use gelatins. In addition, other hydrophilic colloids can be used. For example, proteins such as gelatin derivatives, graft polymers of gelatin and other polymers, albumin, and casein, sugar derivatives such as cellulose derivatives (e.g., hydroxyethyl cellulose, carboxymethyl cellulose, and cellulose sulfate), sodium alginate, and starch derivatives, and various synthetic hydrophilic polymeric substances, homopolymers or copolymers, such as polyvinyl alcohol, polyvinyl alcohol partial acetal, poly(N-vinyl)pyrrolidone, polyacrylic acid, polymethacrylic acid, polyacrylamide, polyvinyl imidazole, and polyvinyl pyrazole can be used.

The light-sensitive material of the present invention is particularly effectively used as a black-and-white reflection light-sensitive material which is to be subjected to rapid processing. In addition, it can be used as an X-ray recording light-sensitive material, a photomechanical process light-sensitive material, a light-sensitive material to be used in a facsimile system, etc., and further, as a multilayer, multicolor photographic light-sensitive material having at least two different spectral sensitivities.

The multilayer, multicolor photographic material usually comprises a support, and at least one red-sensitive emulsion layer, at least one green-sensitive emulsion layer and at least one blue-sensitive emulsion layer on the support. The order in which the above layers are arranged can be chosen appropriately. Usually the red-sensitive emulsion layer contains cyan dye forming couplers, the green-sensitive emulsion layer contains magenta dye forming couplers, and the blue-sensitive emulsion layer contains yellow dye forming couplers. In some cases, other combinations can be employed. Even in the case of the multilayer, multicolor photographic material, the effects of the present invention are exhibited significantly in a reflection light-sensitive material.

Spectral sensitizing dyes may be used in one or more silver halide emulsions useful on the subbed substrates of the present invention. These sensitizing dyes are well known in the art to increase the sensitization of silver halide grains to various portions of the electromagnetic spectrum such as the ultraviolet, blue, green, yellow, orange, red, near infrared, and infrared. These dyes may be used singly or in combination with other dyes to sensitize the emulsions.

The substrate of the invention bears a coating comprising a continuous gelled network of inorganic metal oxide particles, the network containing an ambifunctional silane. The particles preferably have an average primary particle size of less than about 500 or 200 Å. As used herein, the term "continuous" refers to covering the surface of the substrate with virtually no straight-line penetrable discontinuities or gaps in the areas where the gelled network is applied. However, the layer may be and usually is porous, without significant straight-line pores or gaps in the layer. The term "gelled network" refers to an aggregation of colloidal particles linked together to form a porous three-dimensional network. Generally all of or the majority of linkages are from the material of the particles to each other and to the silane, but some binder such as up to about 5% by weight of the metal oxide of gelatin may also be present. The term "porous" refers to the presence of voids between the inorganic metal oxide particles created by the packing of the metal oxide particles. The term "primary particle size" refers to the average size of unagglomerated single particles of inorganic metal oxide. The term "particle" includes spherical, non-spherical, and fibrillar particulate arrangements. If the ambifunctional silane is added to an aqueous metal oxide sol before coating, then the silane will be hydrolyzed at the positions described as (OR') at page 4, line 6, substituting hydroxy groups for the (OR') groups. For example, a triethoxysilane will become a trihydroxysilane. In solution with the metal oxide particles, the hydrolyzed silane molecules may associate with the metal oxide particles by "oxane" bonding in a reversible fashion (Si-OH+HOM(particle)$\longleftrightarrow$Si—O—M(particle)). As the solution is dried into a coated layer, it is expected that most of the hydrolyzed silane molecules will become associated with metal oxide particles through "oxane" bonding such that they cannot be washed out of the coating by a simple water wash. The presence of the silane molecules does not prevent the gelled particle network from gaining cohesive strength, although the time required to gain cohesive strength may be increased.

The coating should be thicker than a monolayer of particles. Preferably the coating comprises a thickness equal to or greater than three average particle diameters and more preferably equal to or greater than five particle diameters.

The articles of the invention comprise a substrate which may be transparent, translucent, or opaque to visible light having at least one polymeric surface, and have formed thereon a coating in the form of a continuous gelled network of inorganic oxide particles with an adhesion promoting effective amount of an ambifunctional silane. When the coating is applied to transparent substrates to achieve increased light transmissivity, the coated article preferably exhibits a total average increase in transmissivity of normal incident light of at least two percent and up to as much as ten percent or more, when compared to an uncoated substrate, depending on the substrate coated, over a range of wavelengths extending at least between 400 to 900 nm. An increase in light transmission of two percent or more is generally visually apparent and is sufficient to produce a measurable increase in energy transmissivity when the coated substrate is used. An increase in transmissivity is also present at wavelengths into the infrared portion of the spectrum.

The gelled network is a porous coating having voids between the inorganic oxide particles. If the porosity is too small, the antireflectance may be reduced. If the porosity is too large, the coating is weakened and may have reduced adhesion to the substrate. Generally, the colloidal solution from which the gelled network is obtained is capable of providing porosity of about 25 to 70 volume percent, preferably about 30 to 60 volume percent when dried. The porosity can be determined by drying a sufficient amount of the colloidal solution to provide a dried product sample of about 50 to 100 mg and analyzing the sample using a "Quantasorb" surface area analyzer available from Quantachrome Corp., Syosett, N.Y.

The voids of the porous coating provide a multiplicity of subwavelength interstices between the inorganic particles where the index of refraction abruptly changes from that of air to that of the coating material. These subwavelength interstices, which are present throughout the coating layer, provide a coating which may have a calculated index of refraction (RI) of from about 1.15 to 1.40, preferably 1.20 to 1.30 depending on the porosity of the coating. When the porosity of the coating is high, e.g., about 70 volume percent or more, lower values for the RI are obtained. When the porosity of the coating is low, e.g., 25 volume percent or less, higher values for the RI are obtained.

The average primary particle size of the colloidal inorganic metal oxide particles is preferably less than about 200 Å. The average primary particle size of the colloidal inorganic metal oxide particles is more preferably less than about 70 Å. When the average particle size becomes too large, the resulting dried coating surface is less efficient as an antireflection coating.

The average thickness of the dried coating is preferably from about 300 to 10,000 Å, more preferably 800 to 5000 Å and most preferably between 900 and 2000 Å. Such coatings provide good antistatic properties. When the coating thickness is too great, the coating has reduced adhesion and flexibility and may readily flake off or form powder under mechanical stress.

Articles such as transparent sheet or film materials may be coated on a single side or on both sides to increase light transmissivity, the greatest increase being achieved by coating both sides.

The process of coating the layer of the present invention comprises coating a substrate with a solution of colloidal inorganic metal oxide particles (and preferably the silane at this point), the solution preferably containing at least 0.2 or 0.5 to 15 weight percent of the particles, the particles preferably having an average primary particle size less than about 500 or 200 Å, more preferably less than about 70 Å, and drying the coating at a temperature less than that which degrades the substrate, preferably less than about 200° C., more preferably in the range of 80° to 120° C. The coating provides the substrate with an average reduction in specular reflectance of at least two percent over wavelengths of 400 to 900 nm.

Coating may be carried out by standard coating techniques such as bar coating, roll coating, knife coating curtain coating, rotogravure coating, spraying and dipping. The substrate may be treated prior to coating to obtain a uniform coating using techniques such as corona discharge, flame treatment, and electron beam. Generally, no pretreatment is required. The ambifunctional silane may be added before, during or after coating. It is preferred to add the silane to the coating mixture before coating. If the silane is added after the "gelled network" has been coated and dried, it should be added from a water-containing solution, so that the silane will be in its hydrolyzed form.

The colloidal inorganic oxide solution, e.g., a hydrosol or organosol, is applied to the substrate of the article to be coated and dried at a moderately low temperature, generally less than about 200° C., preferably 80°-120° C., to remove the water or organic liquid medium. The coating may also be dried at room temperature, provided the drying time is sufficient to permit the coating to dry completely. The drying temperature should be less than at which the substrate degrades. The resulting coating is hygroscopic in that it is capable of absorbing and/or rehydrating water, for example, in an amount of up to about 15 to 20 weight percent, depending on ambient temperature and humidity conditions.

The colloidal inorganic oxide solution utilized in the present invention comprises finely divided solid inorganic metal oxide particles in a liquid. The term "solution" as used herein includes dispersions or suspensions of finely divided particles of ultramicroscopic size in a liquid medium. The solutions used in the practice of this invention are clear to milky in appearance. Inorganic metal oxides particularly suitable for use in the present invention are those in which the metal oxide particles are negatively charged, which includes tin oxide ($SnO_2$), titania, antimony oxide ($Sb_2O_5$), silica, and alumina-coated silica as well as other inorganic metal oxides of Groups III and IV of the Periodic Table and mixtures thereof. The selection of the inorganic metal oxide is dependent upon the ultimate balance of properties desired. Inorganics such as silicon nitride, silicon carbide, and magnesium fluoride when provided in sol form are also useful.

The colloidal coating solution preferably contains about 0.2 to 15 weight percent, more preferably about 0.5 to 8 weight percent, colloidal inorganic metal oxide particles. At particle concentrations about 15 weight percent, the resulting coating may have reduced uniformity in thickness and exhibit reduced adhesion to the substrate surface. Difficulties in obtaining a sufficiently thin coating to achieve increased light transmissivity and reduced reflection may also be encountered at concentrations above about 15 weight percent. At concentrations below 0.2 weight percent, process inefficiencies result due to the large amount of liquid which must be removed and antireflection properties may be reduced.

The thickness of the applied wet coating solution is dependent on the concentration of inorganic metal oxide particles in the coating solution and the desired thickness of the dried coating. The thickness of the wet coating solution is preferably such that the resulting dried coating thickness is from about 80 to 500 nm thick, more preferably about 90 to 200 nm thick.

The coating solution may also optionally contain a surfactant to improve wettability of the solution on the substrate, but inclusion of an excessive amount of surfactant may reduce the adhesion of the coating to the substrate. Examples of suitable surfactants include "Tergitol" TMN-6 (Union Carbide Corp.) and "Triton" X-100 (Rohm and Haas Co.). Generally the surfactant can be used in amounts of up to about 0.5 weight percent of the solution.

The coating solution may optionally contain a very small amount of polymeric binder, particularly a hydrophilic polymer binder, to improve scratch resistance, or to reduce formation of particulate dust during subsequent use of the coated substrate Useful polymeric binders include polyvinyl alcohol, polyvinyl acetate, gelatin, polyesters, polyamides, polyvinyl pyrrolidone, copolyesters, copolymers of acrylic acid and/or methacrylic acid, and copolymers of styrene. The coating solution can contain up to about 5 weight percent of the polymeric binder based on the weight of the inorganic metal oxide particles. Useful amounts of polymeric binder are generally in the range of about 0.1 to 5 weight percent to reduce particulate dust. These binders can reduce some of the beneficial properties (e.g., antistatic properties) of the coatings if used in larger amounts, so that they are not most preferred.

The ambifunctional silane is generally present as at least 0.1% by weight of the solids content of the gelled particulate layer. Preferably the ambifunctional silane is present as from 1 to 20% by weight of the solids content of the particulate layer. More preferably the silane is present as 0.2 to 10% by weight of the solids content of the particulate layer.

The following procedures were used in making all samples used in the following Examples.

EXAMPLES

Experimental Method

Each sample described in the attached table is prepared as follows:

The sol as received from the manufacturer is diluted with water to the desired percent solids. Then the specified coupling agent is added to the diluted sol. The amount of coupling agent is calculated according to the percent weight to metal oxide solids. After addition of coupling agent the mixture is vigorously shaken for 30 sec. to dissolve the coupling agent. Then, 0.05–0.1% wt. of Triton X-100 surfactant is added as a coating aid. This mixture is coated onto an appropriate substrate film by: 1) a 10 cm×20 cm sheet of film is placed on a flat surface; 2) a bead of the mixture is drawn across the top of the sheet (about 1 milliliter); 3) the mixture is spread across the sheet by means of a #4 stainless steel wire-wound rod; 4) the coated sheet is dried in an oven for about two minutes at 100° C. The dried coated sheets are allowed to stand at room temperature for one day or more before further use.

Next, a standard x-ray photographic emulsion is prepared and coated onto the above sheets by: 1) the temperature of the emulsion mixture is adjusted to about 40° C.; 2) a bead of the emulsion (approx. 2 ml) is drawn across the top of a sol-coated sheet; 3) the emulsion is spread across the sheet by means of a #24 stainless steel wire-wound rod; 4) the emulsion coated sheet is dried at 50° C. for about two hours.

Adhesion Test Methods

The following method was used to test all of the experimental samples for emulsion adhesion. Following the tests described below, each sample is given a grade between zero (0) and 10, according to the approximate percentage of emulsion remaining on the sample. Thus if 50% of the emulsion remains the grade is "5". If all of the emulsion remains, the grade is "10".

The test method is: 1) a 5 cm×10 cm portion of the x-ray emulsion coated material from above is immersed in x-ray developer at room temperature for two minutes; 2) the material is removed from the developer and, while still wet with developer, scribed in a cross-hatch pattern with the corner of a razor blade, and rubbed with firm pressure in a circular motion for 24 cycles with a rubber glove-tipped index finger; 3) the sample is washed in cold water and dried; 4) a 2.5 cm×5 cm portion of 3M #610 tape is affixed over the cross-hatched area of the test material and pulled off with a vigorous snap; 5) the sample is graded as described above for emulsion adhesion.

The substrate film used in the examples was 4-mil PET primed with about 0.04 microns of a poly(vinylidene chloride) containing terpolymer.

0.50 g of a 10% wt. solution of Triton-X-100/$H_2O$ was added to each sol mixture to aid in coating.

EXAMPLE 1

Four test samples were prepared according to the above method using the following silica/silane coupling agent coating, solutions:

APS is 3-aminopropyltriethoxysilane

A. 17.2 g Nalco 2326 colloidal silica, 82.6 g $H_2O$, 0.25 g APS (2.5% silica)

B. 17.2 g Nalco 2326 colloidal silica, 82.7 g $H_2O$, 0.125 g APS

C. 27.6 g Nalco 2326 colloidal silica, 72.0 g $H_2$), 0.4 g APS (4.0% silica)

D. 55.2 g Nalco 2326 colloidal silica, 44.0 g $H_2O$, 0.8 g APS (9.0% silica)

Each fully prepared sample was tested for adhesion according to the described method. The adhesion test results for A, C, and D were all "10" (no failure); the grade for B was "9.5".

EXAMPLE 2

Three test samples similar to the samples A, C, and D of Example 1 were prepared, except that no silane coupling agent (APS) was added.

A. 17.2 g Nalco 2326 colloidal silica, 82.8 g $H_2O$

B. 27.6 g Nalco 2326 colloidal silica, 72.4 g $H_2O$

C. 55.2 g Nalco 2326 colloidal silica, 44.8 g $H_2O$

The adhesion test results for A, B and C were all "0" (complete failure).

EXAMPLE 3

Three further samples were prepared in order to test various types of silane coupling agents. The samples were formulated as follows:

A. 27.6 g Nalco 2326 colloidal silica, 72.0 g $H_2O$, 0.40 g γ-glycidoxypropyltrimethoxysilane B. 27.6 g Nalco 2326 colloidal silica, 72.0 g $H_2O$, 0.40 g methacryloxypropyltrimethoxysilane C. 27.6 g Nalco 2326 colloidal silica, 72.0 g $H_2O$, 0.40 g 3-chloropropyltriethoxysilane The adhesion test results were: Sample A, "10", Sample B, "0", Sample C, "0". These results are in agreement with the expected reactivity of the functional groups with gelatin.

EXAMPLE 4

Two samples were prepared in order to test the usefulness of organotitanate coupling agents:

A. 27.6 g Nalco 2326 colloidal silica, 72.0 g $H_2O$, 0.40 g isopropyltri(n-ethylaminoethylamino)titanate B. 27.6 g Nalco 2326 colloidal silica, 72.0 g $H_2O$, 0.40 g di-(dioctylpyrophosphato)ethylenetitanate The adhesion test result for Sample A was "3", for Sample B, "0".

EXAMPLE 5

Three samples were prepared in order to illustrate the use of different sizes/types of colloidal silica:

A. 16.7 g Nalco 1115 colloidal silica, 83.1 g $H_2O$, 0.26 g APS

B. 5.0 g Nalco 1060 colloidal silica, 94.8 g $H_2O$, 0.25 g APS

C. 8.33 g Nalco 1034A colloidal silica, 91.5 g $H_2O$, 0.25 g APS

The adhesion test results for Samples A, B and C were all "10".

EXAMPLE 6

Three samples similar to those of Example 5 were prepared, except that no APS was used. The adhesion test results were all "0".

EXAMPLE 7

Twelve samples were prepared with colloidal metal oxides other than silica:

GPS is γ-glycidoxypropyltrimethoxysilane.

A. 21.4 g Nalco TX-2588 colloidal titania, 78.4 g $H_2O$, 0.25 g APS

B. 8.33 g Nalco 1SJ-612 colloidal silica/alumina, 91.5 g $H_2O$, 0.25 g APS

C. 11.4 g Nalco 1SJ-613 colloidal alumina, 88.4 g $H_2O$, 0.25 g APS

D. 25.0 g Nalco 1SJ-614 colloidal alumina, 74.8 g $H_2O$, 0.25 g APS

E. 10.0 g Nyacol SN-20 colloidal stannic oxide, 89.8 g $H_2O$, 0.25 g APS

F. 17.9 g Nyacol colloidal yttria, 81.9 g $H_2O$, 0.25 g APS

G. 10.4 g Nyacol colloidal zirconia silicate, 89.4 g $H_2O$, 0.25 g APS

H. 12.5 g Nyacol colloidal zirconia acetate, 87.3 g $H_2O$, 0.25 g APS

I. 11.6 g Nyacol colloidal ceric nitrate, 88.2 g $H_2O$, 0.25 g APS

J. 8.33 g Nalco 1SJ-612 colloidal silica/alumina, 91.5 g $H_2O$, 0.25 g GPS

The adhesion test results for Samples A and E were "10", for Samples B, C, D, F, G, H, I and J the results were "0". It is noted that in Samples A and E the colloidal particles are anionic, whereas in all the other samples the particles are cationic.

EXAMPLE 8

Twelve samples similar to those of Example 7, except that no APS or GPS was used, were prepared. The adhesion test results were all "0".

EXAMPLE 9

A silica-coated sample was prepared using the coating mixture 2B and the above-described preparative method. This sample was dipped into a solution of 0.10% APS in ethanol for 15 seconds and air dried. This was then emulsion coated and tested according to the above procedures. The adhesion test result was "10".

EXAMPLE 10

Four silica-coated samples were prepared using the coating mixture 2B and the above-described preparative method. These samples were coated with x-ray emulsion modified as follows:

A. 100 g x-ray emulsion, 0.05 g APS

B. 100 g x-ray emulsion, 0.10 g APS

C. 100 g x-ray emulsion, 0.20 g APS

D. 100 g x-ray emulsion, 0.40 g APS

The adhesion test results were: Samples C and D, "10"; Sample B, "3"; Sample A, "2".

EXAMPLE 11

A silica-coated sample was prepared using the coating mixture 1C, except that 0.56 g of K&K #1312 gelatin was dissolved in the mixture. This was emulsion coated and tested according to the above procedures. The adhesion test result was "10". Furthermore the conductive and optical properties of the silica-coated sample were comparable to those of silica-coated sample prepared with mixture 1C. The terms sol-gel and gelation, as they apply to the use of inorganic dispersions of particles in the formation of layers, are well understood in the art. Sol-gels, as previously described, comprise a rigidized dispersion of a colloid in a liquid, that is the gelled network previously described. Gelation is the process of rigidizing the sol-gel. This is often accompanied by extraction of the liquid. Gelation, as opposed to pyrolysis, does not necessarily require the addition of heat as room temperatures and normal humidity conditions will allow gelation to occur. These temperatures and humidity conditions will eventually remove sufficient amounts of the liquid for the colloidal particles to become more solid. Heat of course can be useful in speeding up the liquid extraction process as would gas flow directed against or parallel to the sol-gel coating.

The liquid extracted sol-gel coating (which will generally retain some significant amounts of liquid, e.g., at least 0.1% by weight up to 10% or 15% or more by weight in some cases) can be described in a number of various physical terms which distinguish it from other particulate constructions such as sintered, adhesively bound, or thermally fused particles. The association of the particles in a sol-gel system is a continuous sol-gel network which is known to mean in the art that the particles form an inorganic polymer network at the intersection of the particle (e.g., as with silica sol-gels), or an inorganic salt system. Bonding forces such as van der Waals forces and hydrogen bonding can form an important part of the mechanism of particle association. These characterizations of sol-gel compositions are quite distinct from the use of polymer binders which form a binding medium to keep particles associated and where the particles themselves do not exert direct bonding forces on one another.

As previously noted, the size of the colloid particles in the sol-gel is important. Processes where particulates are ball-milled generally produce particles of no less than about 1 micron. Unless a chemical process is used to form the particles of smaller size, which agglomerate to effectively form large particles which are then ball-milled to break up the agglomeration, the particle size limit of about 1 micron from physical processing tends to hold true.

Larger particles also cannot be used in sol-gel compositions to form an integral layer by only gelation processes. The large particles do not bond with sufficient strength to withstand any significant abrasion.

What is claimed is:

1. A polymeric film having adhered to at least one surface thereof a layer comprising a continuous gelled network of inorganic particles containing from 0.1 to 20% by weight of solids content of said layer of an ambifunctional silane represented by the formula $$(Q)_n—R—Si(OR^1)_3$$

wherein $R^1$ is alkyl or aryl,

R is the organic group of up to 10 carbon atoms having n+1 external valences, n is 1, or 2, and Q is an amino or epoxy moiety reactive with gelatin hardeners or gelatin.

2. The film of claim 1 wherein said gelled network of inorganic oxide particles comprises a layer having an average thickness of between 800 and 5,000 Angstroms.

3. The film of claim 2 wherein said inorganic oxide particles are selected from the class consisting of silica, titania, tin oxide and mixtures thereof.

4. The film of claim 1 wherein said inorganic particles comprise inorganic metal oxide particles.

5. The film of claim 4 wherein said ambifunctional silane comprises from 0.2 to 10% of said layer.

6. The polymeric film of claim 1 wherein Q is epoxy.

7. The film of claim 1 wherein said ambifunctional silane comprises from 0.2 to 10% of said layer.

8. The film of claim 2 wherein said ambifunctional silane comprises from 0.2 to 10% of said layer.

9. The polymeric film of claim 4 wherein Q is epoxy.

10. A synthetic polymeric film having adhered to at least one surface thereof a layer of a continuous gelled network of inorganic particles comprising silica particles and 0.1 to 20% of said layer of an ambifunctional silane comprising gammaglycidoxypropyltrimethoxysilane.

11. The polymeric film of claim 10 wherein said substrate is a polymeric film selected from the group consisting of polyester, and primed polyester.

12. The film of claim 11 wherein said ambifunctional silane comprises from 0.2 to 10% of said layer.

13. The film of claim 11 wherein said inorganic particles comprise inorganic metal oxide particles.

14. A polymeric film having adhered to at least one surface thereof a layer comprising a continuous gelled network of inorganic particles containing from 0.1 to 20% by weight of solids content of said layers of an ambifunctional silane represented by the formula:

$$(Q)_n—R—Si(OR^1)_3$$

wherein $R^1$ is alkyl of 1 to 4 carbon atoms,

R is a bridging moiety selected from the group consisting of alkylene, arylene, alkarylene, and aralkylene of up to 10 carbon atoms, n is 1, and Q is amino or epoxy.

15. The polymeric film of claim 14 wherein Q is epoxy.

* * * * *